US005762432A

United States Patent [19]

Dunleavy et al.

[11] Patent Number: 5,762,432

[45] Date of Patent: Jun. 9, 1998

[54] MASCARA APPLICATOR HAVING SLOTTED BRISTLES

[75] Inventors: Thomas J. Dunleavy, North Salem; Walter K. Kemmerer, Cortlandt Manor, both of N.Y.

[73] Assignee: Risdon Corporation, Naugatuck, Conn.

[21] Appl. No.: 730,503

[22] Filed: Oct. 11, 1996

Related U.S. Application Data

[63] Continuation-in-part of Ser. No. 477,919, Jun. 7, 1995, Pat. No. 5,567,072.

[51] Int. Cl.[6] ..... A46D 1/00

[52] U.S. Cl. ..... 401/129

[58] Field of Search ..... 401/118, 126, 401/129

[56] References Cited

U.S. PATENT DOCUMENTS

| | | |
|---|---|---|
| D. 331,150 | 11/1992 | Hartel . |
| 2,317,485 | 4/1943 | Rider . |
| 2,433,325 | 12/1947 | Slaughter . |
| 2,439,039 | 4/1948 | Coe . |
| 2,465,396 | 3/1949 | Peterson et al. . |
| 2,637,893 | 5/1953 | Shaw . |
| 2,895,155 | 7/1959 | Peterson . |
| 3,121,040 | 2/1964 | Shaw et al. . |
| 3,217,074 | 11/1965 | Gould et al. . |
| 3,344,457 | 10/1967 | Grobert . |
| 3,383,276 | 5/1968 | Gould . |
| 4,279,053 | 7/1981 | Payne et al. . |
| 4,307,478 | 12/1981 | Ward et al. . |
| 4,364,996 | 12/1982 | Sugiyama . |
| 4,365,642 | 12/1982 | Costa . |
| 4,376,746 | 3/1983 | Ward et al. . |
| 4,403,624 | 9/1983 | Montgomery . |
| 4,461,312 | 7/1984 | Gueret . |
| 4,545,393 | 10/1985 | Gueret et al. . |
| 4,559,268 | 12/1985 | Nakashima et al. . |
| 4,561,456 | 12/1985 | Gueret . |
| 4,565,205 | 1/1986 | Taylor . |
| 4,632,136 | 12/1986 | Taylor . |
| 4,660,582 | 4/1987 | Taylor . |
| 4,733,425 | 3/1988 | Hartel et al. . |
| 4,804,004 | 2/1989 | Kingsford . |
| 4,807,652 | 2/1989 | Bachrach . |
| 4,861,179 | 8/1989 | Schrepf et al. . |
| 4,887,622 | 12/1989 | Gueret . |
| 4,927,281 | 5/1990 | Gueret . |
| 4,961,665 | 10/1990 | Fitjer . |
| 4,974,612 | 12/1990 | Gueret . |
| 4,993,440 | 2/1991 | Gueret . |
| 5,002,415 | 3/1991 | Gueret . |
| 5,020,551 | 6/1991 | Guerret . |
| 5,063,947 | 11/1991 | Gueret . |
| 5,064,306 | 11/1991 | Gueret . |
| 5,096,319 | 3/1992 | Gueret . |
| 5,161,554 | 11/1992 | Fitjer . |

(List continued on next page.)

FOREIGN PATENT DOCUMENTS

| | | | |
|---|---|---|---|
| 2225225 | 5/1990 | United Kingdom | 401/129 |

*Primary Examiner*—William E. Stoll

*Attorney, Agent, or Firm*—St. Onge Steward Johnston & Reens

[57] ABSTRACT

An applicator for the application of a cosmetic medium, such as mascara, is disclosed having a central core, preferably formed from a twisted metal wire, having a brush section at one end thereof. The brush section comprises a plurality of radially extending bristles gripped medially by the wire core. At least some of the bristles have a substantially slotted cross-sectional configuration, most preferably, each bristle is substantially c-shaped, hollow and has a longitudinal slot extending along at least a portion of the length of the bristle, and preferably along the entire length of the bristle. The cross-sectional configuration of the slotted filaments is such that the gripping thereof by the core causes the slotted filaments to flare outwardly in a generally random direction and so as to be substantially uniformly distributed throughout the brush section; unlike the prior art bristles, the bristles of the present invention do not follow a substantially helical pattern when gripped by the twisted wire core.

23 Claims, 2 Drawing Sheets

U.S. PATENT DOCUMENTS 5,165,760 11/1992 Gueret .
5,197,497 3/1993 Gueret .
5,238,011 8/1993 Gueret .
5,335,465 8/1994 Gueret .
5,345,644 9/1994 Gueret .
5,357,647 10/1994 Gueret .
5,482,059 1/1996 Miraglia .
5,491,865 2/1996 Gueret .
5,588,447 12/1996 Gueret ..... 401/129 X
5,595,198 1/1997 Kemmerer ..... 401/129 X 30
32
10
12
16
18
14

34
26
28

38
θ
37
22
36
18

38A
θ
37A
36A
18A 46
44
40
D1
37B
42
36B
18B

52
D2
48
37C
50
36C
18C

MASCARA APPLICATOR HAVING SLOTTED BRISTLES

CROSS REFERENCE TO RELATED APPLICATIONS

The present application is a continuation-in-part of application Ser. No. 08/477,919, filed on Jun. 7, 1995, now issued as U.S. Pat. No. 5,567,072, entitled "Mascara Applicator Having Slotted Bristles," invented by Thomas J. Dunleavy and Walter K. Kemmerer.

FIELD OF THE INVENTION

The present invention relates to applicators used to apply cosmetics, and, more particularly, to applicators used to apply mascara to eyelashes.

BACKGROUND OF THE INVENTION

Mascara applicators having a single metallic wire which is folded in a u-shaped configuration and having nylon bristles disposed therebetween are known. Generally, the u-shaped wire is twisted to form a helical core; the twisting of the core causes the bristles, or filaments, to be arranged about the core in a substantially helical or spiral pattern. See e.g., U.S Pat. No. 5,165,760 to Gueret; U.S Pat. No. 4,887,622 to Gueret; and U.S Pat. No. D331,150 to Hartel.

The twisted wire applicators of the aforementioned type may comprise, for example, bristles having any one or a combination of the following cross-sectional configurations: hollow and tubular (see e.g., U.S. Pat. No. 4,733,425 to Hartel et al.); solid and tubular (see e.g., U.S. Pat. No. 5,165,760 to Gueret); or cruciform (see e.g., U.S. Pat. No. 4,887,622 to Gueret). Conventional bristles having any of the aforementioned cross-sectional configurations, however, fail to maximize the cosmetic product carrying surface because mascara pickup is limited to the exterior surface of the bristle; thus the product pickup and product retention is not maximized. When the product pickup and retention is insufficient, the user must reintroduce the mascara applicator into the reservoir and repeatedly stroke the eyelashes to apply a desirable amount of mascara and to obtain a uniform application of it.

U.S. Pat. No. 4,927,281 to Gueret discloses bristles having various cross-sectional configurations, wherein one of the bristles is tubular and has a slot (13) extending between the ends of the bristle. See FIGS. 3–8; Col. 2, lines 64–68. The patent illustrates a tubular bristle having a slot extending about 25 degrees. This small slot can be disadvantageous, especially when used with a highly viscous cosmetic medium. When a highly viscous cosmetic medium is used, it may be unable to pass through the slot and into the hollow interior.

The '281 patent also teaches that each mascara brush comprises bristles having at least two different cross-sectional configurations. Col. 2, lines 60–64. An advantage asserted by the '281 patent resides in that when the bristles having different cross-sections are crimped by the metal wire core, they are spaced apart differently, but always space (15) remains between the bristles. The space (15) is large enough to be penetrated by an eyelash. Col. 3, lines 5–8.

A brush made in accordance with the '281 patent is disadvantageous, however, in that bristle arrangement has many spaces (15) therein which may be penetrated by an eyelash. These spaces prevent the applicator from carrying the maximum amount of mascara. An additional disadvantage resides in that a brush having bristles of two different cross-sectional configurations is expensive to manufacture and time consuming to assemble. Bristles of a first cross-sectional configuration must be properly intermixed with bristles of a second cross-sectional configuration to ensure that space (15) resides therebetween.

U.S. Pat. No. 5,482,059 likewise shows a mascara applicator comprising multiple types of bristles, such as a slotted tubular bristle. A mascara brush made in accordance with the '059 patent is disadvantageous because it requires particular placement of particular types of bristles in the brush section. For example, it requires that the middle section comprise both stiff and soft bristles having a configuration such that they do not flare out in a generally helical pattern when crimped by the wire core; in contrast, the two end sections are made up of stiff bristles, different than the stiff bristles used in the middle section, configured so that they maintain a generally spiral configuration when crimped by the metal wire core. For the reasons discussed above, a mascara brush made in accordance with the '059 patent is disadvantageous because it is difficult and time consuming to correctly position the bristles in the brush section; further, it is expensive to manufacture many different types of bristles.

Mascara applicators wherein the bristles are arranged in a generally spiral or helical manner, or which have spaces (15) as taught by the '281 patent to Gueret, are sometimes undesirable because they do not maximize the surface area which can apply the mascara to the eyelashes. For example, if the core has relatively few turns, there can be wide gaps between bristles at a predetermined location and their neighbors directly above and directly below that location. These gaps, which contain no bristles, do not pick up and carry mascara, and, as such, reduce the amount of cosmetic medium which can be carried by the applicator and applied to a user's eyelashes.

U.S. Pat. No. 4,733,425 to Hartel attempts to provide an applicator having a wire core, wherein the bristles, when twisted, do not follow the helical pattern of the twisted wire core. Hartel discloses, however, only hollow tubular bristles, and bristles that are noncircular in cross-section and which have a plurality of longitudinal, radially extending flange or rib portions, such as a "cruciform" filament. As discussed above, these bristles fail to maximize product pickup and retention.

What is desired, therefore, is a cosmetic applicator which comprises bristles having a single cross-sectional configuration, which do not follow a helical or spiral pattern when gripped by a twisted wire core, which do not have spaces therebetween when gripped by the core, which maximize the amount of cosmetic product pickup and retention, which provide a smooth and uniform application of the cosmetic medium to the eyelashes, and which are relatively inexpensive to manufacture and easy to assemble.

SUMMARY OF THE INVENTION

Accordingly, it is an object of the present invention to provide an applicator which comprises bristles, which, when bound by a twisted metal core, are arranged in an "interwoven" manner, that is, a manner wherein the bristles are not arranged in a substantially spiral or helical manner.

It is another object of the present invention to provide a mascara applicator which maximizes the amount of cosmetic product pickup and retention.

It is yet another object of the present invention to provide a mascara applicator wherein the mascara is not limited to the exterior surface of the bristle, but rather can pass through a relatively large longitudinal slot in the bristle.

It is still a further object of the present invention to provide a mascara applicator comprised of bristles having a single cross-sectional configuration.

It is yet a further object of the present invention to provide a mascara applicator which is comparatively inexpensive to manufacture and quick and easy to assemble.

To overcome the deficiencies of the prior art and to achieve the objects and advantages listed above, a mascara applicator is disclosed which comprises a central core preferably formed from a twisted wire and having a brush section at one end thereof. The brush section comprises a plurality of regularly disposed and radially extending bristles having a cross-sectional configuration of any of the types discussed below and sufficient stiffness or rigidness such that when gripped medially (i.e., between the ends thereof) by the core, they are arranged in an "interwoven" pattern and, as such, do not strictly follow the helical pattern of the twisted wire core.

In the preferred embodiment, at least some of the bristles, and preferably all of the bristles, comprise a filament having a substantially slotted cross-sectional configuration. In other words, these bristles are hollow and have a slot extending along at least a portion of the length of the bristles, and, preferably, along the entire length of the bristles. The slot in each type of bristle is sufficiently sized to allow the passage of the cosmetic medium, such as mascara, into the slot increasing the amount of product retention. Because the slot provides for an interruption of an otherwise smooth outer bristle surface, mascara accumulates in the slot resulting in increased product retention when compared to conventional bristles. Further, depending on various factors, including the viscosity of the mascara and the size of the slot, additional mascara may flow through the slot and into the interior of the filament, providing even more product retention.

Different "types" of generally slotted bristles are disclosed herein. In one type, the filament is generally a rounded c-shape and a slot extends along at least a portion of the sidewall of the filament. The angle of opening, which defines the size of the slot, extends about 30° to about 180° wide, but preferably extends about 45° to about 150° wide; most preferably, it is about 55° to about 120° wide.

In another type of preferred bristle, the filament comprises four sidewalls positioned to form a generally rectangularly-shaped c-shaped filament, wherein the corners are "squared off," and a slot extends along about 40% to about 85% of one sidewall, but preferably 45% to about 80% of one sidewall, and most preferably, 50% to about 75% of one sidewall.

In still another type of preferred bristle, the filament comprises three sidewalls positioned to form a generally triangularly-shaped, c-shaped filament and a slot extends along about 40% to about 85% of one sidewall, but preferably 45% to about 80% of one sidewall, and most preferably, 50% to about 75% of one sidewall.

Other types of preferred bristles are also disclosed. For example, the filament could be oval in cross-section (sometimes referred to as a generally oval "c-shape") or "block C" in cross-section (sometimes referred to as a generally rectangularly "c-shaped" filament, wherein the corners are "rounded off"). As with the other bristles previously discussed, a slot extends along at least a portion, and preferably the entire length, of the filament. It should be understood that the location of the slot on these bristles, as with any of the bristles disclosed herein, could be at any position on the bristle. The position of the slot on the bristle is not intended to be limited to the exact positions shown.

It should be understood that, in all the types of filaments disclosed herein, the filaments are constructed of sufficient rigidness such that when crimped by the metal wire core, the filaments flair outwardly in a generally random fashion and do not follow the helical pattern of the twisted wire core.

It should also be understood that, in all the types of filaments disclosed herein, the slot extends, preferably, along the entire length of the filament. The slot can, however, extend only partially along the length of the filament, if desired.

The cross-sectional configuration and rigidness of each of the types of slotted filaments is such that the gripping thereof causes the filaments to flare outwardly in a substantially random direction so as to be substantially uniformly distributed throughout the brush section. Thus, the slotted bristles, when crimped by the twisted wire core, generally flare outwardly in a substantially V-shaped manner. The flaring action by the bristles constructed in accordance with the present invention is substantially random in the radial direction and results in a substantially uniform bristle tip distribution in the brush section of the applicator. This is in contrast to the characteristically helical pattern of the bristle distribution of the prior art. Advantageously, due to the slotted cross sectional configurations of the bristles and the resulting "interwoven" design, the applicator of the present application provides more product retention when compared to conventional mascara applicators.

Significantly, bristles made in accordance with the present invention allow for more product pickup and retention because the cosmetic medium is not limited to the exterior of the bristles unlike prior art bristles and rather can accumulate in the slot and from there it can be transferred to a user's eyelashes. That is, depending on various factors such as the size of the slot and the viscosity of the cosmetic medium, the cosmetic medium may flow through the slot and into the substantially hollow interior of the bristle, resulting in still further product retention.

The invention and its particular features and advantages will become more apparent from the following detailed description when considered with reference to the accompanying drawings.

Figure 11:
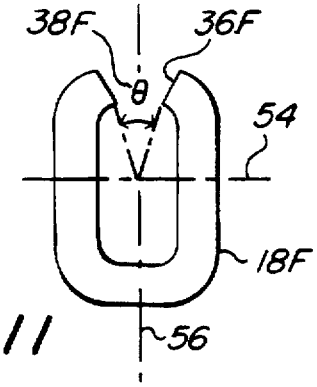
FIG. 11 is an end view of a "block C"-shaped bristle, sometimes referred to as a generally rectangular "c-shaped"
Figure 12:
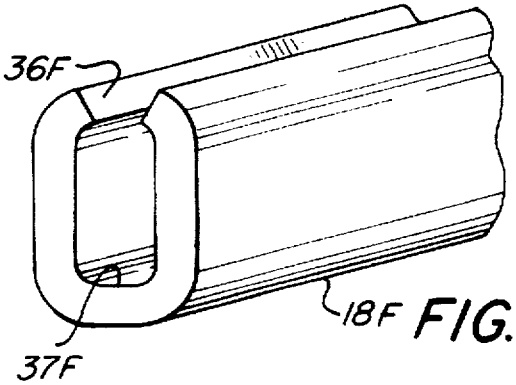
Figure 13:
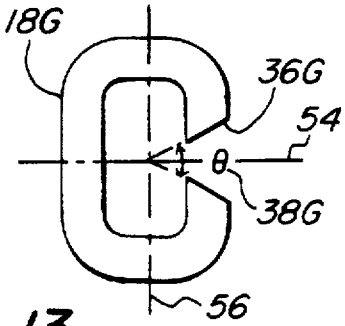
Figure 14:
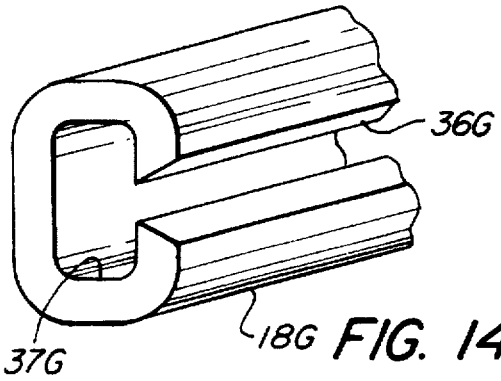

bristle having rounded corners, wherein the slot is positioned along the minor axis;

FIG. 12 is an isometric view of the "block C" shaped bristle shown in FIG. 11, with portions broken away;

FIG. 13 is an end view of a "block C"-shaped bristle having rounded corners, wherein the slot is positioned along the major axis; and FIG. 14 is an isometric view of the "block C" shaped bristle shown in FIG. 13, with portions broken away.

DETAILED DESCRIPTION OF THE DRAWINGS

Referring to the drawings in detail, a mascara applicator in accordance with the present invention is shown and generally designated by the reference numeral 10. It should be noted that for the sake of clarity all the components and parts of applicator 10 may not be shown and/or marked in all the drawings. As used in this description, the terms "up", "down", "top", "bottom", etc. refer to applicator 10 when in the orientation illustrated in FIG. 2, although it will be recognized that applicator 10 may be in any orientation when in use.

Figures 1, 2, 3, 4, 5, 6:
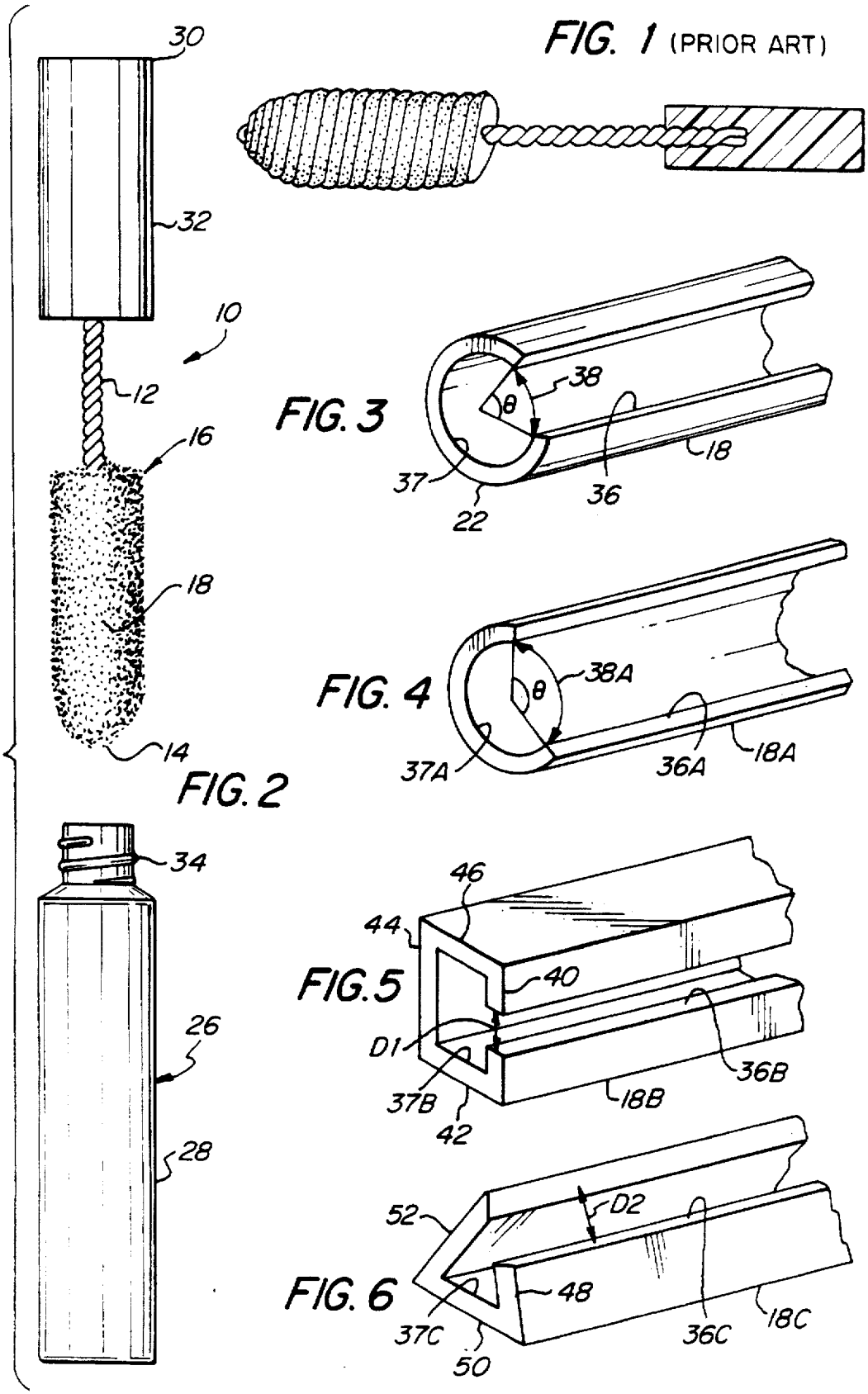
FIG. 1 (PRIOR ART)
FIG. 1 is a side view in partial cross-section of a prior art applicator, wherein the bristles, when gripped by a twisted wire core, are disposed in a generally helical or spiral manner about the core.
FIG. 2 is a side view of a mascara applicator constructed in accordance with the present invention, showing the filaments arranged in an "interwoven" fashion.
FIG. 3 is an isometric view of a single bristle (with portions broken away), which may be gripped by the core of the applicator shown in FIG. 2.
FIGS. 4–6 are isometric views of additional bristles of alternate types with portions broken away, which could be used in conjunction with, or in lieu, of the bristle of FIG. 3 for use in the applicator shown in FIG. 2.

As best shown in FIG. 2, applicator 10 comprises a central core 12 having a first end 14 and brush section 16 extending from first end 14 along central core 12. A plurality of regularly disposed and radially extending bristles, such as 18 (best shown, for example, in FIG. 3) comprise brush section 16. Each bristle 18, for example, has two free ends, one end identified as 22 (FIG. 3).

Referring to FIG. 2, applicator 10 is adapted in size and shape so as to be conveniently stored in a container 26, when not in use or when necessary to pick up mascara for application to a user's eyelashes. Container 26, having housing 28, has an internal chamber or reservoir (not shown), for storing a cosmetic medium, such as mascara, as is known in the art. One suitable reservoir is shown and described in U.S. Pat. No. 4,365,642 to Costa, and entitled "Cosmetic Applicator and Associated Method", the disclosure of which is hereby incorporated by reference.

Core 12 can be made of any suitable material and by any suitable method sufficient to hold and retain bristles 18, but it is preferably made of steel, and most preferably, stainless steel.

Referring to FIG. 2, core 12 has bristles 18, for example, disposed at one end (i.e., brush section 16), while the other end 30 comprises handle 32 to facilitate the application of the mascara and which also serves as a cap for container 26 when not in use. Handle 32 has a threaded portion (not shown) designed so as to be received by complementary threaded portion 34 of container 26 to seal cap 32 to container 26 so that mascara is stored in a relatively leak-proof manner.

Referring to FIGS. 2, 3, a multiplicity of generally c-shaped, slotted bristles, sometimes referred to as filaments, such as 18 are regularly disposed about brush section 16 of core 12. Bristles 18 can be made of any material capable of carrying and applying mascara and may be formed by any suitable method such as by the extrusion of a plastic material. Suitable materials include any type of synthetic material, including polyamide, polyesters, polyolefins and the like. Preferably bristles 18 are made of nylon, and most preferably made of 6–12 type nylon.

Bristles 18 preferably have a length of about 0.100 mils to about 0.380 mils. It should be understood, however, that bristles 18 may be any length provided they are sufficiently long to pick up and retain mascara and sufficiently long to comb the user's eyelashes.

In accordance with the present invention, at least some of the bristles 18, for example, in brush section 16 comprise a filament having a substantially slotted cross-sectional configuration. The cross-sectional configuration of each filament is such that the gripping thereof by core 12 causes it to flare radially outwardly in a substantially random direction and so as to be generally uniformly distributed throughout brush section 16.

Referring to FIGS. 3 and 4, at least some bristles, and preferably each bristle, 18, 18A is generally c-shaped and hollow, and has a slot 36, 36A, respectively, extending longitudinally between the ends of the bristle 18, 18A, along at least a portion of the length of the bristle 18, 18A, and most preferably along the entire length of bristle 18, 18A. Slot 36, 36A may be of any size and shape sufficient to allow the passage of cosmetic medium into slot 36, 36A and, if desired, into interior 37, 37A of filament 18, 18A. Slot 36, 36A is measured through an angle of opening θ 38, 38A, which is about 30° to about 180°; preferably, θ 38, 38A is about 45° to about 150°; most preferably, θ 38, 38A is about 55° to about 120°. It should be understood that other ranges are also preferred, such as 45° to about 100°, and 75° to about 120°. Filaments 18 exhibit a significant capillary attraction for the cosmetic medium, and, as such, are capable of picking up and retaining more mascara than conventional mascara applicators.

Bristles 18 are attached to core 12 in a manner generally known in the art. Preferably, core 12 is folded in a generally U-shaped configuration (not shown) and the bristles, such as 18, are substantially medially disposed between the legs of the U-shaped core and the legs of core 12 are twisted. Unlike most prior art bristles (FIG. 1) in which the bristle distribution follows the helical path of the twisted wire core, the bristle distribution of the present invention is substantially random and, to a great extent, uniformly distributed throughout brush section 16, resulting in an "interwoven" pattern. See FIG. 2.

Other types of bristles 18B, 18C are shown in FIGS. 5–6, respectively. Bristle 18B, shown in FIG. 5, comprises four sidewalls 40, 42, 44, 46 positioned so as to form a generally rectangularly-shaped filament, wherein the corners are substantially "squared off." Slot 36B extends along at least some and preferably the entire length of a sidewall such as 42 and is sufficiently sized to allow the passage of cosmetic medium into slot 36B and, if desired, into the interior 37B of filament 18B. In the preferred embodiment, slot 36B is open along about 50% to about 75% of one sidewall. Slot 36B, preferably, has a height D1 of about 0.0005 to about 0.0025 inches, and most preferably between about 0.001 to about 0.002 inches.

Bristle 18C, shown in FIG. 6, comprises three sidewalls 48, 50, 52 positioned to form a generally triangularly-shaped filament. Slot 36C extends along at least a portion of one sidewall such as 48, but preferably extends along the entire length of the sidewall. Slot 36C is sized sufficiently to allow the passage of cosmetic medium into slot 36C and, if desired, into the interior 37C of filament 18C. In the preferred embodiment, slot 36C is open along about 50% to about 75% of the sidewall. Preferably, it has a height D2 of about 0.0005 to about 0.0025 inches, and most preferably between about 0.001 to about 0.002 inches.

Figure 7:
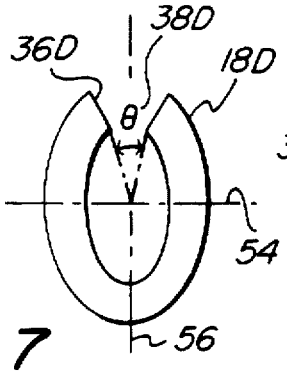
FIG. 7 is an end view of an oval c-shaped bristle, wherein the slot is positioned along the minor axis.
Figure 8:
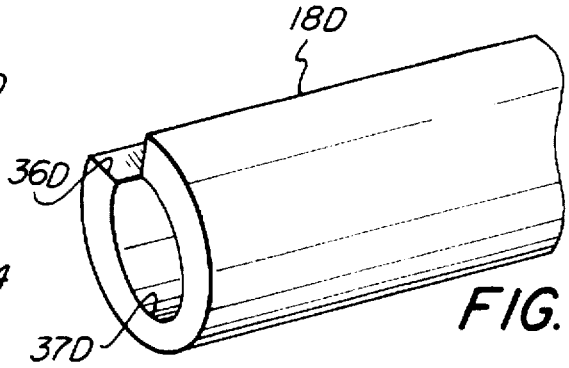
FIG. 8 is an isometric view of the oval c-shaped bristle shown in FIG. 7, with portions broken away.
Figure 9:
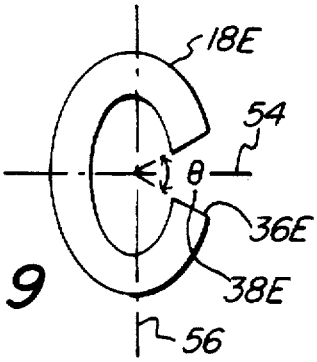
FIG. 9 is an end view of an oval c-shaped bristle, wherein the slot is positioned along the major axis.
Figure 10:
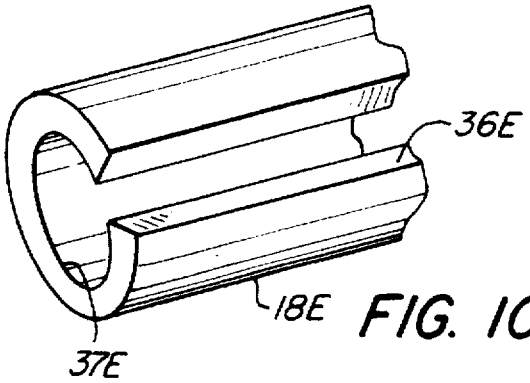
FIG. 10 is an isometric view of the oval c-shaped bristle shown in FIG. 9, with portions broken away.

Other types of bristles are shown in FIGS. 7–14. For example, an oval c-shaped filament 18D, wherein the slot 36D is positioned along the minor axis 54 is shown in FIGS. 7–8. An oval c-shaped bristle or filament 18E, wherein the slot 36E is positioned along the major axis 56 is shown in FIGS. 9–10.

Additionally, FIGS. 11–12 illustrate a "block C"-shaped filament 18F (sometimes referred to as a generally rectangularly "c-shaped" filament, wherein the corners are substantially "rounded off"), wherein the slot 36F is positioned along the minor axis 54. In contrast, FIGS. 13–14 illustrate a "block C"-shaped bristle 18G having substantially rounded corners, wherein the slot 36G is positioned along the major axis 56. As shown, the "block C" shaped filaments 18F, 18G (FIGS. 11–14) comprises four sidewalls, each joined to each other at their ends. The ends, as shown in the preferred embodiment, are substantially rounded.

Slots 36D, 36E, 36F, 36G extend along at least a portion of the length of bristle 18D, 18E, 18F, 18G, and most preferably extend along the entire length of bristle 18D, 18E, 18F, 18G, respectively. Slots 36D, 36E, 36F, 36G may be any size and shape sufficient to allow the passage of cosmetic medium into slot 36D, 36E, 36F, 36G and into the interior 37D, 37E, 37F, 37G of the respective filaments. See FIGS. 8, 10, 12, 14.

Slots 36D, 36E, 36F, 36G are measured through an angle of opening θ 38D, 38E, 38F, 38G, which is about 30° to about 180°; preferably, θ 38D, 38E, 38F, 38G is about 45° to about 150°; most preferably, θ 38D, 38E, 38F, 38G is about 55° to about 120°. It should be understood that other ranges are also preferred, such as 45° to about 100°, and 75° to about 120°. See FIGS. 7, 9, 11, 13.

Each bristle 18, 18A, 18B, 18C, 18D, 18E, 18F, 18G disclosed herein is constructed of sufficient rigidness such that when crimped by the metal core 12 (FIG. 2), they flare outwardly in a generally random fashion and do not follow the generally helical pattern of twisted wire core 12.

It should be understood that slots 36, 36A, 36B, 36C, 36D, 36E, 36F, 36G are preferably sized to maximize the amount of cosmetic pick-up and retention. It should further be understood that slots 36, 36A, 36B, 36C, 36D, 36E, 36F, 36G most preferably extend the entire length of bristle 18, 18A, 18B, 18C, 18D, 18E, 18F, 18G, respectively, but may, as desired, extend along only a portion of the bristle.

Advantageously, bristles 18, 18A, 18B, 18C, 18D, 18E, 18F, 18G allow for more product pick-up and retention than prior art bristles, because bristles 18, 18A, 18B, 18C, 18D, 18E, 18F, 18G do not limit the cosmetic medium to the exterior of the bristles. That is, the cosmetic medium may be picked up and retained inside slot 36, 36A, 36B, 36C, 36D, 36E, 36F, 36G of bristle 18, 18A, 18B, 18C, 18D, 18E, 18F, 18G respectively. Further, depending on various factors, including the viscosity of the mascara and the size of the slot, additional cosmetic medium may flow through the slot and into the interior of the filament, providing even more product retention.

It should also be understood that an applicator of the present invention could utilize only one type of bristle 18, 18A, 18B, 18C, 18D, 18E, 18F, 18G or any combination of bristles 18, 18A, 18B, 18C, 18D, 18E, 18F, 18G, as desired.

Each of the filaments of the different types of the present invention (FIGS. 3-14) are adapted to pickup and retain more cosmetic medium than conventional bristles and to transport more cosmetic medium to the eyelashes, for example, with reduced possibilities of dripping. Further, each of the bristles 18, 18A, 18B, 18C, 18D, 18E, 18F, 18G, of the present invention provide for more uniform application of the mascara to the eyelashes than conventional bristles.

It should be further understood that the location of the slots 36, 36A, 36B, 36C, 36D, 36E, 36F, 36G can be at the position shown in the drawings, but this application is not intended to be limited to such. That is, slots 36, 36A, 36B, 36C, 36D, 36E, 36F, 36G may be positioned anywhere on the bristle.

It should also be understood that the invention has been described for use with mascara applicators for the sake of convenience only and is not intended to be limiting. Other articles may be made in a similar manner after reading and understanding this disclosure.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. An applicator for the application of a cosmetic medium, comprising: a central core having a brush section at one end thereof, the brush section comprising a plurality of radially extending bristles gripped by the central core, at least some of the bristles comprising a hollow filament having a cross-section defined by a sidewall which is non-uniform in radius from a center of said filament, said filament having two ends and a slot extending substantially longitudinally between the ends and through said sidewall, the slot being sufficiently sized to allow the passage of cosmetic medium into the slot and into the substantially hollow interior, the slot having an angle of opening, the angle of opening being about 30° to about 180°, the rigidness of the filaments being such that the gripping thereof by the core causes them to flare outwardly in a generally random direction so as to be substantially uniformly distributed throughout the brush section.

2. The applicator for the application of cosmetic medium of claim 1, the angle of opening being about 45° to about 150°.

3. The applicator for the application of cosmetic medium of claim 1, the angle of opening being about 55° to about 120°.

4. The applicator for the application of cosmetic medium of claim 1, the angle of opening being about 45° to about 100°.

5. The applicator for the application of cosmetic medium of claim 1, the angle of opening being about 75° to about 120°.

6. The applicator for the application of cosmetic medium of claim 1, wherein said filament cross-section is a substantially "block C" shape having four sidewalls, each of the sidewalls having opposing ends, each of the sidewalls being joined at their ends with rounded corners.

7. The applicator for the application of cosmetic medium of claim 1, wherein said filament cross-section is a substantially oval c-shape having a sidewall with a greater cross-sectional diameter along one cross-sectional axis, and a lesser cross-sectional diameter along a second cross-sectional axis, the first and second cross-sectional axes being perpendicular to each other.

8. An applicator for the application of a cosmetic medium, comprising: a wire core having a brush section at one end thereof, the brush section comprising a plurality of radially extending bristles gripped by the wire core, at least some of the bristles comprising filament having a cross-section which is a substantially rectangular block c-shape having four sidewalls, each of the sidewalls having opposing ends, each of the sidewalls being joined at their ends with rounded corners, the rectangular block c-shaped filament having a substantially hollow interior and having two ends and a slot extending substantially longitudinally between the ends and through a portion of one of the sidewalls, the slot being sufficiently sized to allow the passage of mascara into the slot and into the substantially hollow interior, the rigidness of the filaments being such that the gripping thereof by the wire core causes them to flare outwardly in a generally random direction so as to be substantially uniformly distributed throughout the brush section.

9. The applicator of claim 8, wherein two of said sidewalls are shorter sidewalls, said two shorter sidewalls being connected to each other by two longer sidewalls, and wherein said slot extends through one of said shorter sidewalls.

10. The applicator of claim 8, wherein two of said sidewalls are shorter sidewalls, said two shorter sidewalls being connected to each other by two longer sidewalls, and wherein said slot extends through one of said longer sidewalls.

11. An applicator for the application of a cosmetic medium, comprising:

a central core having a brush section at one end thereof, the brush section comprising a plurality of radially extending bristles gripped by the central core, at least some of the bristles comprising a filament having a cross-section which is a substantially oval c-shaped filament having a sidewall with a greater cross-sectional diameter along one cross-sectional axis and a lesser cross-sectional diameter along a second cross-sectional axis, the first and second cross-sectional axes being perpendicular to each other, said oval c-shaped filament having a substantially hollow interior and having two ends and a slot extending substantially longitudinally between the ends and through said sidewall, the slot being sufficiently sized to allow the passage of cosmetic medium into the slot and into the substantially hollow interior, the rigidness of the oval c-shaped filaments being such that the gripping thereof by the core causes them to flare outwardly in a generally random direction so as to be substantially uniformly distributed throughout the brush section.

12. The applicator of claim 11, wherein said slot extends through said sidewall at an end thereof along said one cross-sectional axis.

13. The applicator of claim 11, wherein said slot extends through said sidewall at a side thereof along said second cross-sectional axis.

14. The applicator for the application of cosmetic medium of claims 11, 12 or 13, the slot having an angle of opening, the angle of opening being about 30° to about 180°.

15. The applicator of claims 8, 9, or 10, the slot having an angle of opening, the angle of opening being about 30° to about 180°.

16. The applicator of claim 15, the slot having an angle of opening, the angle of opening being about 45° to about 150°.

17. The applicator of claim 15, the slot having an angle of opening, the angle of opening being about 55° to about 120°.

18. The applicator of claim 15, the slot having an angle of opening, the angle of opening being about 45° to about 100°.

19. The applicator of claim 15, the slot having an angle of opening, the angle of opening being about 75° to about 120°.

20. The applicator for the application of cosmetic medium of claim 14, the slot having an angle of opening, the angle of opening being about 45° to about 150°.

21. The applicator for the application of cosmetic medium of claim 4, the slot having an angle of opening, the angle of opening being about 55° to about 120°.

22. The applicator for the application of cosmetic medium of claim 14, the slot having an angle of opening, the angle of opening being about 45° to about 100°.

23. The applicator for the application of cosmetic medium of claim 14, the slot having an angle of opening, the angle of opening being about 75° to about 120°.

* * * * *